United States Patent [19]

Kralik

[11] Patent Number: 4,608,545

[45] Date of Patent: Aug. 26, 1986

[54] MOVABLE CONTACT ARM ASSEMBLY FOR A CURRENT LIMITING CIRCUIT BREAKER

[75] Inventor: Andrew J. Kralik, Marysville, Ohio

[73] Assignee: Siemens-Allis, Inc., Atlanta, Ga.

[21] Appl. No.: 779,587

[22] Filed: Sep. 24, 1985

[51] Int. Cl.[4] ..... H01H 75/00; H01H 77/00; H01H 83/00

[52] U.S. Cl. ..... 335/16; 335/147; 335/190; 335/192; 335/194; 335/195; 335/15; 200/147 R

[58] Field of Search ..... 335/16, 147, 190, 192, 335/194, 195, 6, 15, 189; 200/147 R

[56] References Cited

U.S. PATENT DOCUMENTS

| | | | |
|---|---|---|---|
| 3,198,924 | 8/1965 | Brumfield et al. | 200/170 |
| 3,564,184 | 2/1971 | Gauthier et al. | 200/166 |
| 4,480,242 | 10/1984 | Castonguay et al. | 335/194 |
| 4,484,164 | 11/1984 | McClellan et al. | 335/16 |
| 4,488,133 | 12/1984 | McClellan et al. | 335/16 |
| 4,491,814 | 1/1985 | Bellows | 335/192 |
| 4,562,419 | 12/1985 | Preuss et al. | 335/195 |

*Primary Examiner*—E. A. Goldberg
*Assistant Examiner*—Lincoln Donovan
*Attorney, Agent, or Firm*—F. W. Powers; J. L. James

[57] ABSTRACT

A movable contact arm assembly is provided for a circuit breaker. The contact assembly includes a carrier which has first and second guide plates with aligned roller guides and bracket supports and a roller which has a middle portion extending between the guide plates and the end portions and engaging the roller guides. A bracket extends between the guide plates and engages the bracket supports. A spring is positioned between the bracket and roller which urges the roller along the roller guide. The contact arm has first and second cam surfaces and is positioned between the guide plates and pivotally connected thereto. The roller rides in the guide on the first and second cam surfaces and the roller moves from the first cam surface to the second cam surface as the contact arm moves from a closed position to an open position in response to preselected electromagnetic repulsion forces.

15 Claims, 3 Drawing Figures

MOVABLE CONTACT ARM ASSEMBLY FOR A CURRENT LIMITING CIRCUIT BREAKER

CROSS-REFERENCE TO RELATED APPLICATIONS

This application is related to application Ser. No. 779,682, filed Sept. 24, 1985, "Stationary Contact Assembly For A Current Limiting Circuit Breaker" filed by the present inventor and assigned to the assignee of this application.

BACKGROUND OF THE INVENTION

This invention relates generally to circuit breakers and more particularly to a movable contact arm assembly for a circuit breaker with a blow open contact arrangement.

Current limiting circuit breakers are advantageous to use because they can increase the interrupting current rating of a circuit breaker without appreciably increasing the size of the circuit breaker. Circuit breakers are constantly being improved to increase interrupting current rating, reduce size or to reduce the manufacturing cost. The user of a circuit breaker is genuinely concerned about the physical size of the circuit breaker, the electrical and thermal ratings of the circuit breaker and, of course, the cost of the circuit breaker. Accordingly, it can be appreciated that it would be highly desirable to provide a circuit breaker which makes efficient use of space, has an increased current carrying capability and is relatively easy to manufacture.

The blow open circuit breaker increases the interrupting current rating of the circuit breaker without appreciably increasing the overall size of the unit when compared to the size that a traditional unit would have for the same current interrupting capability. Although current limiting circuit breakers are well established in the work place, there is a never ending need for increased current interrupting capacity in the same physical space. As wonderful as the current limiting circuit breaker with blow open contacts may be, there are problems. One problem is that to interrupt higher currents in the confined space, the speed of the contact opening action must be sufficiently fast that an arc is properly drawn and the contacts do not weld shut. Also, at higher current ratings, greater contact pressure when the contacts are closed is needed to minimize the contact resistance and the heat generated thereby.

To insure adequate contact closing pressure, springs have been used to hold the contacts closed. Upon the occurrence of a fault or over current condition, the contacts open against the force of the spring. Quite understadably, having to work against the force of the spring slows the opening action of the circuit breaker which limits its current interrupting capability. Accordingly, it can be appreciated that it would be highly desirable to provide a circuit breaker which provides adequate spring closing force yet can react quickly to open when a fault occurs.

Past attempts to overcome the problem of balancing the spring closing force with the fast opening of the contacts have employed the use of various springs and cams and roller arrangements which mechanically reduce the spring closing force as the contacts begin to open. The spring force acting to keep the contacts closed is reduced from a maximum value when the contacts are closed to some lesser value as the contacts are opened. There is always a closing force acting on the contacts urging them toward the closed position. Accordingly, it will be appreciated that it would be highly desirable to provide a spring force to maintain the contacts in a closed position which would not hinder the opening of the contacts.

Accordingly, it is an object of the present invention to provide a movable contact arm assembly for a circuit breaker.

Another object of the present invention is to provide a movable contact arm assembly which has a positive closing force acting thereon.

Yet another object of the present invention is to provide a movable contact assembly which, after overcoming initial spring closing force, opens freely.

SUMMARY OF THE INVENTION

Briefly stated, in accordance with one aspect of the invention, the foregoing objects are achieved by providing a movable contact arm assembly which has a carrier having first and second guide plates with aligned roller guides and bracket supports and a roller which has a middle portion extending between the guide plates and end portions which engage the roller guides. A bracket extends between the guide plates and engages the bracket supports and a spring is positioned between the bracket and roller which urges the roller along the roller guide. The contact arm has first and second cam surfaces and is positioned between the guide plates and pivotally connected thereto. The roller rides in the guide on the first and second cam surfaces and the roller moves from the first cam surface to the second cam surface as the contact arm moves from a closed position to an open position and responds to preselected electromagnetic repulsion forces.

BRIEF DESCRIPTION OF THE DRAWINGS

While the specification concludes with claims particularly pointing out and distinctly claiming the subject matter which is regarded as the invention, it is believed that the invention will be better understood from the following description of the preferred embodiment taken in conjunction with the accompanying drawings in which:

DESCRIPTION OF A PREFERRED EMBODIMENT

Figure 1:
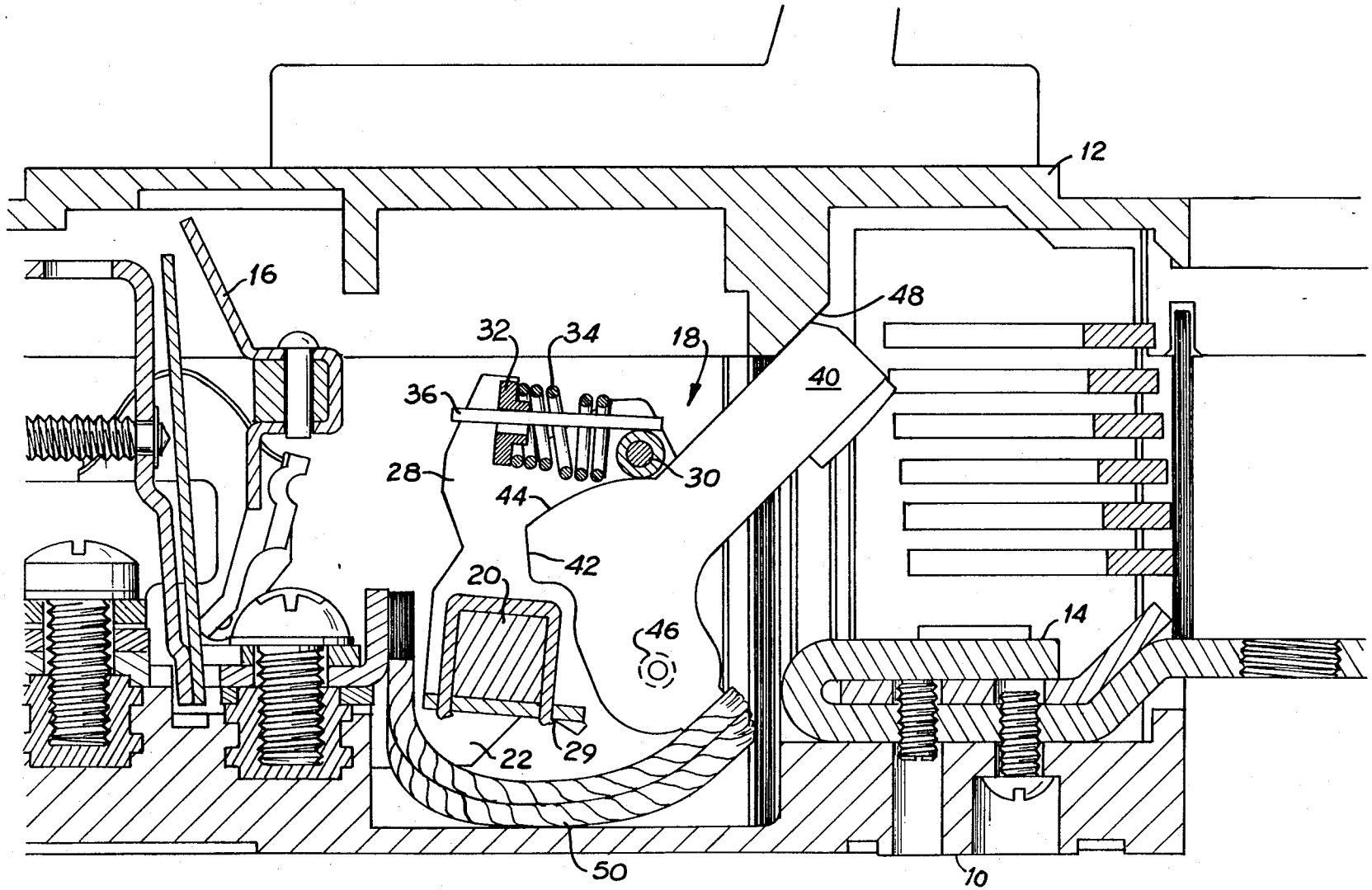
FIG. 1 is a sectional view taken along the longitudinal axis of a pole of a circuit breaker illustrating a movable contact assembly shown with the circuit breaker mechanism on but with the contacts in an open position as would be the case after a blow open operation.

Referring to FIG. 1, a molded case circuit breaker is shown which comprises a base 10 and a cover 12 which define an internal cavity into which is placed the internal portions of the circuit breaker including a stationary contact assembly 14, a thermal-magnetic tripping unit 16 and the movable contact assembly 18. The movable contact arm assembly 18 is mounted on a crossbar 20 which in turn is supported by a mounting bracket 22 which is secured to the base. The breaker can be opened and closed by using the main breaker arm to open and close the breaker via the crossbar member as is known in the arm.

Figure 2:
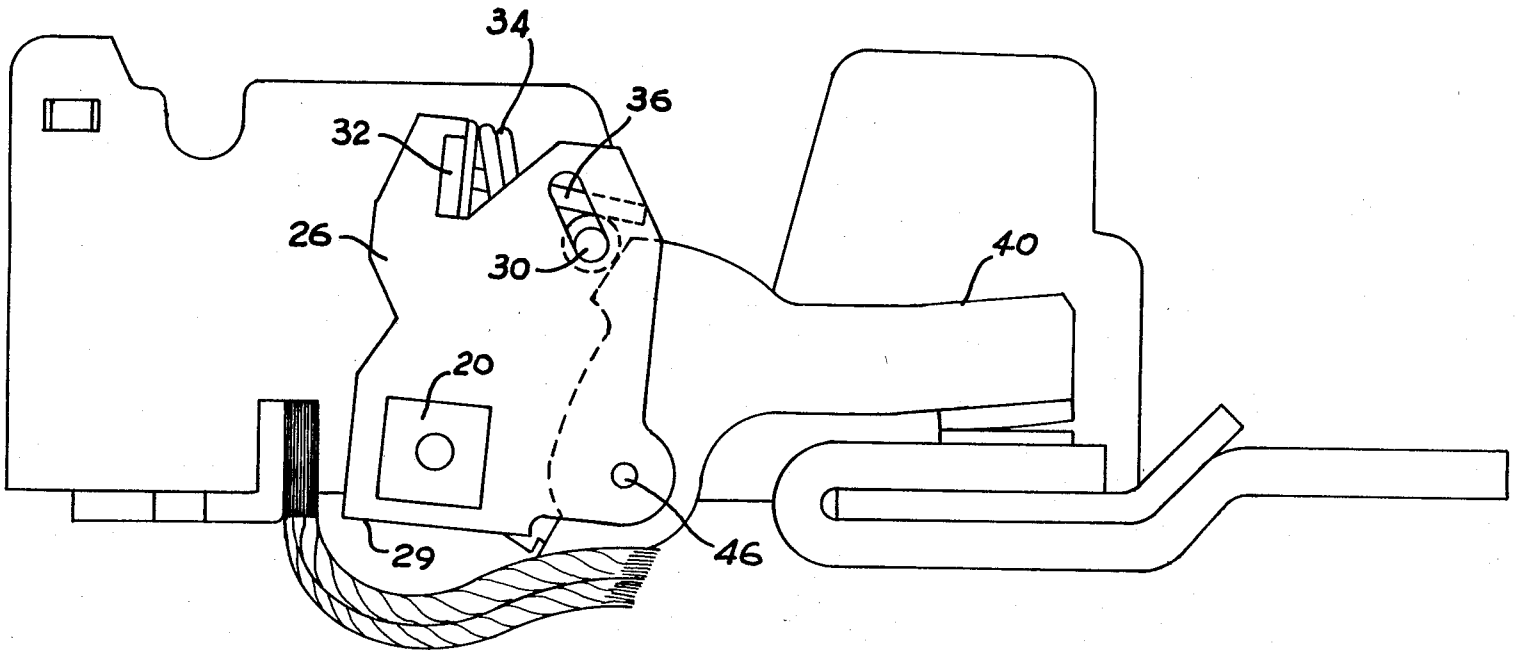
FIG. 2 is a simplified side view similar to FIG. 1 but illustrating the movable contact assembly with the circuit breaker mechanism in the on position and with the contacts closed.
Figure 3:
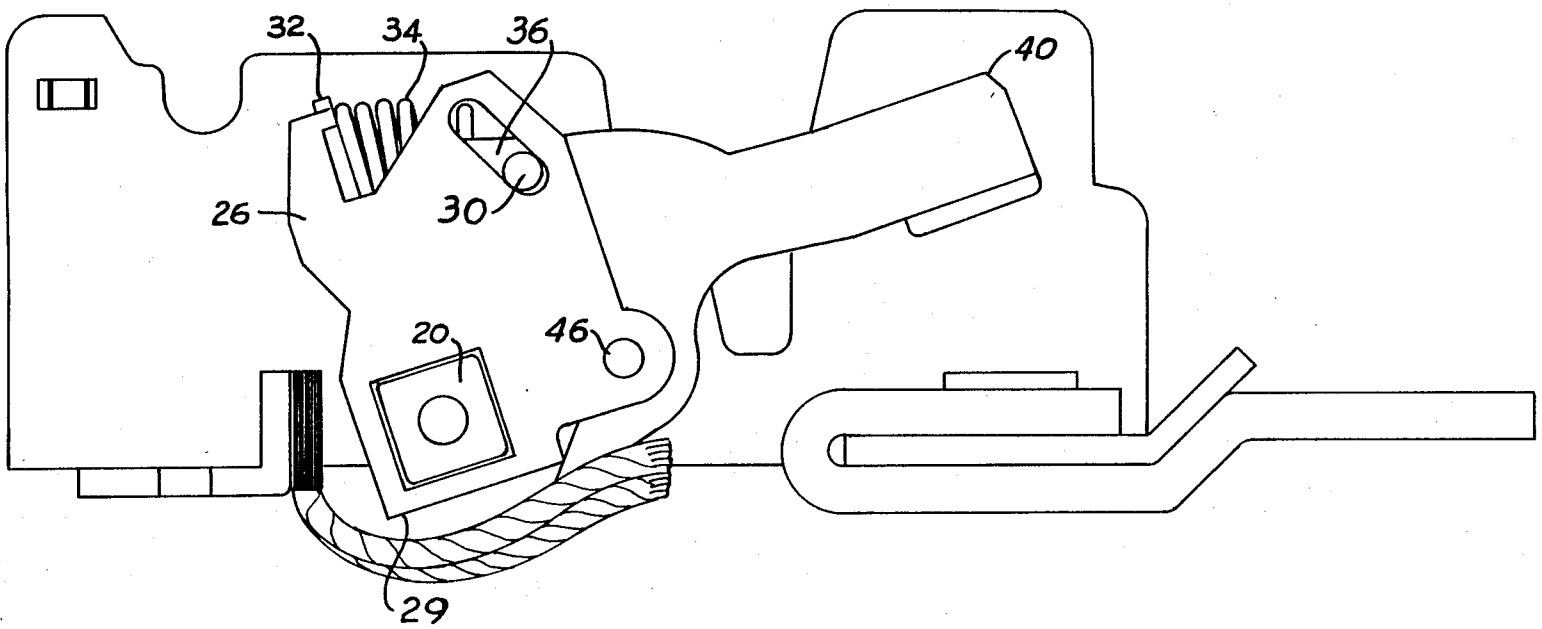
FIG. 3 is a simplified side view similar to FIG. 1 illustrating the movable contact assembly with the circuit breaker mechanism off and the contacts in the open position.

Referring to FIGS. 1 through 3, the movable contact arm assembly 18 includes a carrier 24 which has a first guide plate 26 (FIG. 3) and a second guide plate 28 connected by a base member 29 (FIG. 1). The guide plate 26, 28 have aligned roller guides and bracket supports. A roller 30 has a middle portion and end portions and extends between the guide plates 26, 28 with the end portions engaging the roller guides. A bracket 32 extends between the guide plates 26, 28 and engages the bracket supports. A spring 34 is positioned between the bracket 32 and roller 30 urging the roller along the roller guide.

A spring guide 36 extends inside the spring 34 which is preferably a coil spring and has one end slidably connected to the bracket 32 and the other end in contact with the roller. The portion of the spring guide which slidingly engages the bracket 32 preferably has an arcuate cross-sectional configuration and the bracket preferably has an arcuate opening for facilitating a relative sliding motion between the spring guide 36 and the bracket 32. The spring guide 36 preferably has a pair of fingers for engaging the end portions of the rollers, one finger engaging one end portion of the roller and the other finger engaging the other end of the roller so that the roller is supported on each end by the fingers.

The contact arm assembly 18 has a contact arm 40 with a first cam surface 42 and a second cam surface 44. The contact arm 40 also has a contact affixed thereto and is pivotally connected to the carrier 24 by a pin 46. The contact arm is positioned between the guide plates 26, 28 and is pivotally connected thereto.

A pigtail 50 is connected to the contact arm 40 near the pivot point 46 of the arm and is routed under the carrier 24 in an arcuate path.

Operation of the movable contact assembly can best be illustrated by referring to FIG. 2 which shows the circuit breaker in the "ON" position, that is, the circuit breaker handle is in the "ON" position and the circuit breaker contacts are closed. It is seen that in the closed position the roller 30 rests on the first cam surface 42. In this position, the ends of the roller are positioned at the lower portion of the roller guide. The coil spring 34 is compressed and exerts a force on the first cam surface through the roller 30. Since the movable contact arm 40 pivots about the pin or pivot point 46, the force exerted by the spring 34 creates a torque which tends to urge the movable contact arm toward the closed position. In this case, the force exerted by the spring acts along a line parallel to the axis of the spring guide 36. The force exerted by the spring 34 will always act in a direction parallel to the axis of the spring guide 36 so that in the closed position there is a resultant horizontal force acting on the contact arm at its point of contact with the roller which creates the torque to close the contacts. The torque or closing force is a product of the horizontal force times the distance from the pivot point to the point of application of the force. As shown in FIG. 2, the distance between the pivot point and point of application of the force by the spring is approximately equal to the distance from the pivot point to the first cam surface. This distance is the torque arm distance and the torque is a function of the spring force and distance.

Referring now to FIG. 3, with the roller 30 engaging the first cam surface 42, the circuit breaker handle can be operated to open the breaker or the breaker may open in response to normal tripping operation by means of the thermal magnetic tripping unit 16. When normal tripping occurs, the movable contact arm 40 is pivoted upward along with the carrier 24 because the carrier is attached to the crossbar member 20 and moves with the crossbar. The crossbar member extends through aligned openings and is pivotally connected to the mounting bracket and is movable with the carrier between the open and a closed position. Movement of the crossbar to open and close the contacts does not change the relationship between the roller 30 and the cam surfaces 42, 44. The relationship between the roller and the cam surfaces is unchanged; thus, the movable contact assembly moves from the position indicated in FIG. 2 to the position indicated in FIG. 3 in response to manual operation of the circuit breaker or in response to tripping by the thermal magnetic tripping unit.

Referring now to FIG. 1, the contact arm is shown in the open position which occurs as the result of an overcurrent or fault condition. As shown, the roller 30 is no longer in contact with the first cam surface 42, but is now in contact with the second cam surface 44. This has occurred as the result of an over current or fault condition which created electromagnetic blow open forces sufficiently strong to force the contact arms to separation. This separation occurred against the force of the spring exerted on the first cam surface creating the closing torque as mentioned above. In response to the fault current condition creating a blow open force which creates a force to oppose the closing torque, the contacts begin to separate against the force of the spring. As the spring is compressed, the roller follows the roller guide which forces the roller vertically upward from its lowermost position where it is in contact with the first cam surface. As the contacts begin to open and the roller moves up the roller guide, it is seen that the force exerted by the spring still acts on the first cam surface and still develops a closing torque. However, this torque becomes less as the roller moves up the roller guides because of the angle of the spring and the direction of the spring force relative to the pivot point. This is true until the transition point between the first cam surface and the second cam surface is reached. At that point, the closing torque abruptly and completely drops to zero, because at that point the spring no longer exerts a horizontal force on the contact arm through the roller. At that point, there not only is not a horizontal force exerted against the movable contact arm, but there is also very little vertical force acting on the contact arm. The torque dropped to zero when the transition was made from the first cam surface to the second cam surface. Thus, once the contacts begin to separate and are separated a small distance, the closing torque abruptly drops to zero and does not hinder the contacts from opening completely; yet, the closing torque is sufficient to provide adequate closing pressure.

As the movable contacts opens further in response to the electromagnetic repulsion forces, the contact arm abuts a protrusion or reset cam 48 which is formed in the cover. As the contact arm abuts the reset cam, the upward motion of the contact arm is halted and, when the breaker trips normally via the thermal-magnetic trip unit or by means of the circuit breaker handle, the crossbar will rotate the carrier and attempt to rotate the contact arm also. Since the contact arm abuts the reset cam and cannot be rotated further, the carrier assembly rotates relative to the contact arm and the roller moves back down the second cam surface toward the first cam surface. As the crossbar continues to rotate the carrier, the roller 30 negotiates the transition between the second cam surface and the first cam surface and snaps back into position to again exert a closing torque on the arm. At this point, the arm is reset and ready for another operation.

It will now be appreciated that there has been presented a circuit breaker with a movable contact arm assembly which makes efficient use of space and which provides a positive closing force acting on the movable contact arm. The movable contact assembly, after overcoming the initial closing torque, opens freely because the closing torque abruptly drops to zero. The pigtail connector is routed underneath the movable contact arm assembly in an arcuate or oval-shaped path which creates electromagnetic forces which assist the opening operation of the contact arm.

During operation, electromagnetic forces urge the side legs of the oval-shaped pigtail loop towards one another causing the loop to elongate and exert an opening force on the contact arm.

As will be evident from the foregoing description, certain aspects of the invention are not limited to the particular details of the examples illustrated, and it is therefore contemplated that other modifications or applications will occur to those skilled in the art. It is accordingly intended that the claims shall cover all such modifications and applications as do not depart from the true sprit and script of the invention.

What is claimed as new and desired to be secured by Letters Patent of the United States:

1. A movable contact arm assembly for a circuit breaker comprising:

a carrier having first and second guide plates with aligned roller guides and bracket supports;

a roller having a middle portion extending between the guide plates and end portions engaging the roller guides;

a bracket extending between the guide plates and engaging the bracket supports;

a spring positioned between the bracket and roller urging the roller along the roller guide; and a contact arm having first and second cam surfaces and being positioned between the guide plates and pivotally connected thereto, said roller riding in said guide on said first and second cam surfaces, said roller moving from the first cam surface to the second cam surface as the contact arm moves from a closed position to an open position in response to preselected electromagnetic repulsion forces.

2. A movable contact arm assembly according to claim 1, wherein the spring acting through the roller on the first cam surface provides a closing torque for the contact arm which abruptly drops to zero as the roller moves from the first cam surface to the second cam surface.

3. A movable contact arm assembly according to claim 1, including a spring guide extending inside the coil spring and having one end slidably connected to the bracket and the other end in contact with the roller.

4. A movable contact arm assembly according to claim 3, wherein the spring guide has a pair of fingers engaging the end portions of the roller.

5. A movable contact arm assembly according to claim 1, including a contact affixed to the arm and a pigtail conductor connected to the arm near the pivot point of the arm.

6. A movable contact arm assembly according to claim 5, wherein the pigtail is routed under the carrier in an arcuate path which creates an electromagnetic force to assist the opening operation of the arm.

7. A movable contact arm assembly according to claim 5, wherein the pigtail has side legs and an oval configuration and wherein an electromagnetic force urges the side legs of the oval-shaped pigtail loop towards one another causing the loop to elongate and exert an opening force on the contact arm.

8. A movable contact arm assembly according to claim 1, including:

a base member connecting the guide plates, said guide plate having aligned openings adjacent to said base;

a mounting bracket; and a crossbar member extending through said aligned openings and pivotally connected to the mounting bracket and movable with the carrier between an open position and a closed position.

9. A movable contact arm assembly according to claim 8, wherein the contact arm moves with the crossbar and carrier between the open and closed positions with the roller engaging the first cam surface.

10. A movable contact arm assembly according to claim 8, wherein the contact arm moves against the force of the spring in response to the electromagnetic repulsion forces with the crossbar and carrier in the closed position.

11. A movable contact arm assembly for a circuit breaker having a base and a cover, comprising:

a carrier having first and second guide plates with aligned roller guides and bracket supports;

a roller having a middle portion extending between the guide plates and end portions engaging the roller guides;

a bracket extending between the guide plates and engaging the bracket supports;

a spring positioned between the bracket and roller urging the roller along the roller guide; and a contact arm having first and second cam surfaces and being positioned between the guide plates and pivotally connected thereto, said roller riding in said guide on said first and second cam surfaces, said roller moving from the first cam surface to the second cam surface as the contact arm moves from a closed position to an open position in response to preselected electromagnetic repulsion forces, said spring acting through the roller on the first cam surface providing a closing torque for the contact which abruptly drops to zero as the roller moves from the first cam surface to the second cam surface.

12. A movable contact arm assembly according to claim 11, including:

a base member connecting the guide plates, said guide plates having aligned openings adjacent to said base;

a mounting bracket connected to the base; and a crossbar member extending through said aligned openings and pivotally connected to the mounting bracket and movable with the carrier between an open position and a closed position.

13. A movable contact arm assembly according to claim 12, wherein the contact arm moves with the crossbar and carrier between the open and closed positions with the roller engaging the first cam surface.

14. A movable contact arm assembly according to claim 12, wherein the contact arm moves against the force of the spring in response to the electromagnetic repulsion forces with the crossbar and carrier in the closed position.

15. A movable contact arm assembly according to claim 12, including a reset cam in the cover, said contact arm abutting said cam during an opening operation automatically resetting the contact arm so that the roller engages the first cam surface preparing the arm for closing.

* * * * *